US011532426B2

(12) United States Patent
Kim et al.

(10) Patent No.: US 11,532,426 B2
(45) Date of Patent: Dec. 20, 2022

(54) INDUCTOR

(71) Applicant: SAMSUNG ELECTRO-MECHANICS CO., LTD., Suwon-si (KR)

(72) Inventors: Seung Hee Kim, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 522 days.

(21) Appl. No.: 16/556,795

(22) Filed: Aug. 30, 2019

(65) Prior Publication Data

US 2020/0135383 A1 Apr. 30, 2020

(30) Foreign Application Priority Data

Oct. 29, 2018 (KR) ..... 10-2018-0130031

(51) Int. Cl.
*H01F 27/29* (2006.01)

(52) U.S. Cl.
CPC ..... *H01F 27/29* (2013.01)

(58) Field of Classification Search
CPC ..... H01F 27/29; H01F 2017/048; H01F 17/0013; H01F 17/04; H01F 27/255; H01F 27/292; H01F 27/24; H01F 27/28; H01F 27/2847; H01F 27/306; H01F 17/0006; H01F 27/323
See application file for complete search history.

(56) References Cited

U.S. PATENT DOCUMENTS

| | | | | |
|---|---|---|---|---|
| 8,201,318 | B2 * | 6/2012 | Yamano | H01F 41/122 29/842 |
| 10,269,482 | B2 | 4/2019 | Yoneda et al. | |
| 2016/0141102 | A1 * | 5/2016 | Tseng | H01F 27/292 336/200 |
| 2016/0351314 | A1 | 12/2016 | Jeong et al. | |
| 2016/0372261 | A1 * | 12/2016 | Ozawa | H01F 17/0013 |
| 2017/0004918 | A1 * | 1/2017 | Kido | H01F 5/00 |
| 2017/0103848 | A1 * | 4/2017 | Yoneda | H01F 17/0013 |
| 2017/0256353 | A1 | 9/2017 | Park et al. | |

FOREIGN PATENT DOCUMENTS

| | | | |
|---|---|---|---|
| CN | 103440958 | A | 12/2013 |
| CN | 106205955 | A | 12/2016 |
| CN | 106716566 | A | 5/2017 |
| CN | 107017083 | A | 8/2017 |
| CN | 107680774 | A | 2/2018 |
| CN | 107895618 | A | 4/2018 |
| JP | 2017-73536 | A | 4/2017 |
| KR | 10-2015-0089213 | A | 8/2015 |

OTHER PUBLICATIONS

Chinese Office Action dated Sep. 27, 2022, issued in corresponding Chinese Patent Application No. 201911014513.7.

* cited by examiner

*Primary Examiner* — Sizo B Vilakazi
(74) *Attorney, Agent, or Firm* — Morgan, Lewis & Bockius LLP

(57) ABSTRACT

An inductor includes a body, a coil disposed inside the body, and first and second external electrodes disposed on one surface of the body to respectively be connected to both ends of the coil. A recess portion is disposed in a region between the first and second external electrodes on the one surface of the body.

22 Claims, 4 Drawing Sheets

INDUCTOR

CROSS-REFERENCE TO RELATED APPLICATION(S)

This application claims benefit of priority to Korean Patent Application No. 10-2018-0130031 filed on Oct. 29, 2018 in the Korean Intellectual Property Office, the disclosure of which is incorporated herein by reference in its entirety.

TECHNICAL FIELD

The present disclosure relates to an inductor.

BACKGROUND

In accordance with the miniaturization and thinning of electronic devices such as digital TVs, mobile phones, laptop PCs, and the like, there is an increasing demand for miniaturization and thinning of coil components used in such electronic devices. In order to meet such demand, research and development into developing a winding type or thin-film type coil component having various forms have been actively undertaken.

An inductor, a coil component, is a representative passive electronic component, used together with a resistor and a capacitor in electronic devices.

As electronic devices are designed to have higher performance and to be reduced in size, electronic components used in electronic devices have been increased in number and reduced in size.

SUMMARY

An aspect of the present disclosure is to provide a low-profile inductor product by changing a shape and a ratio of a bottom surface electrode to prevent short-circuits between both electrodes and cracking when the bottom surface electrode is formed.

Specifically, an aspect of the present disclosure is to prevent short-circuits between bottom surface electrodes after soldering and to prevent short-circuits between a coil and the bottom surface electrode, such that the soldering is optimized and mounting stability is enhanced.

According to an aspect of the present disclosure, an inductor includes a body, a coil disposed inside the body, and first and second external electrodes disposed on one surface of the body to respectively be connected to both ends of the coil. A recess portion is disposed in a region between the first and second external electrodes on the one surface of the body.

According to an aspect of the present disclosure, an inductor includes a body having a recess portion recessed from one surface of the body toward a central portion of the body, a coil disposed inside the body and wound around the central portion of the body, and first and second external electrodes disposed on opposing sides of the one surface and connected to ends of the coil, respectively.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
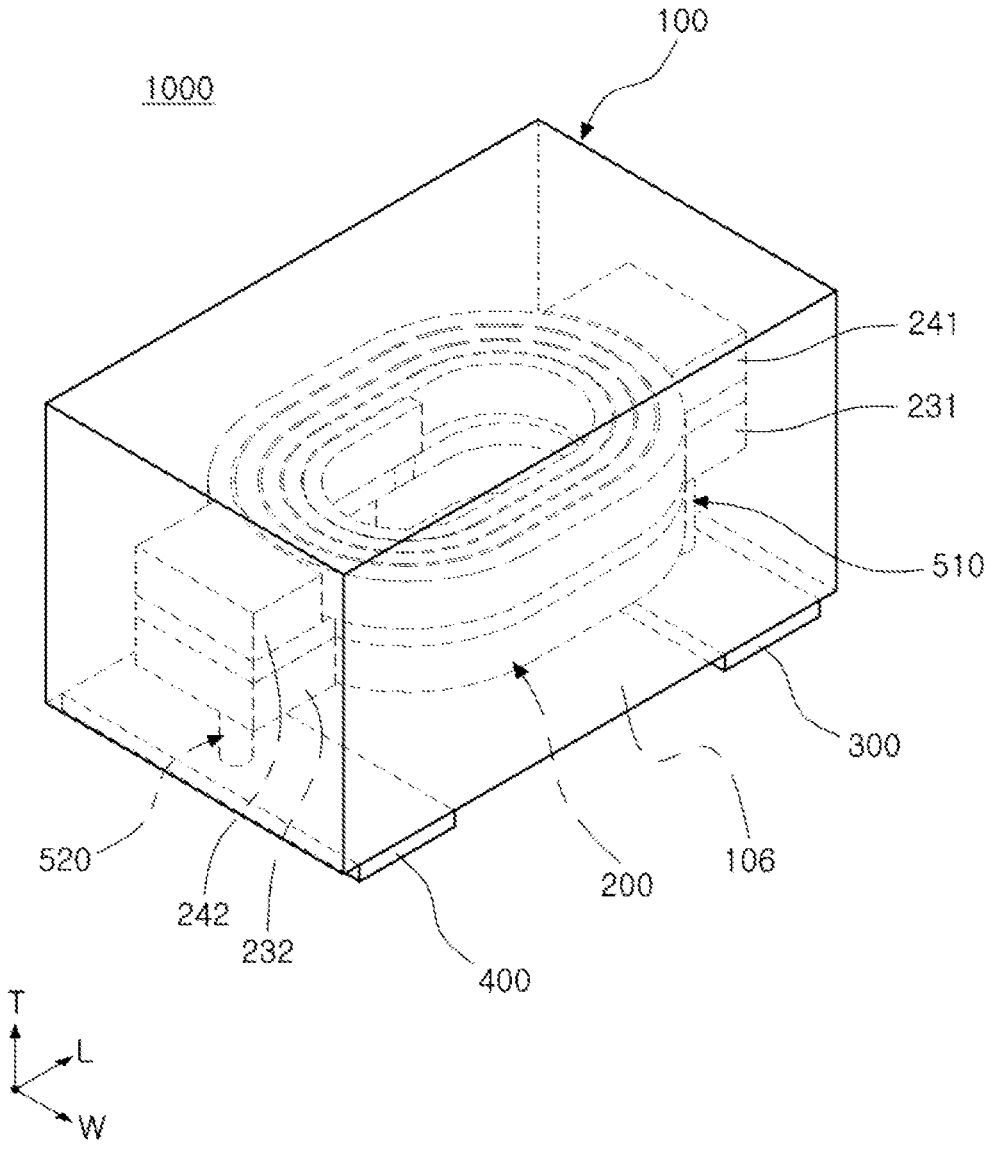
FIG. 1 is a schematic diagram of an inductor according to embodiments in the present disclosure.

Hereinafter, embodiments of the present disclosure will be described as follows with reference to the attached drawings.

The terms used in the example embodiments are used to simply describe an example embodiment, and are not intended to limit the present disclosure. A singular term includes a plural form unless otherwise indicated. The terms used in the example embodiments are used to simply describe an example embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned below an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and example embodiments in the present disclosure are not limited thereto.

In the drawings, an L direction is a first direction or a length direction, a W direction is a second direction and a width direction, a T direction is a third direction or a thickness direction.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

Figure 2:
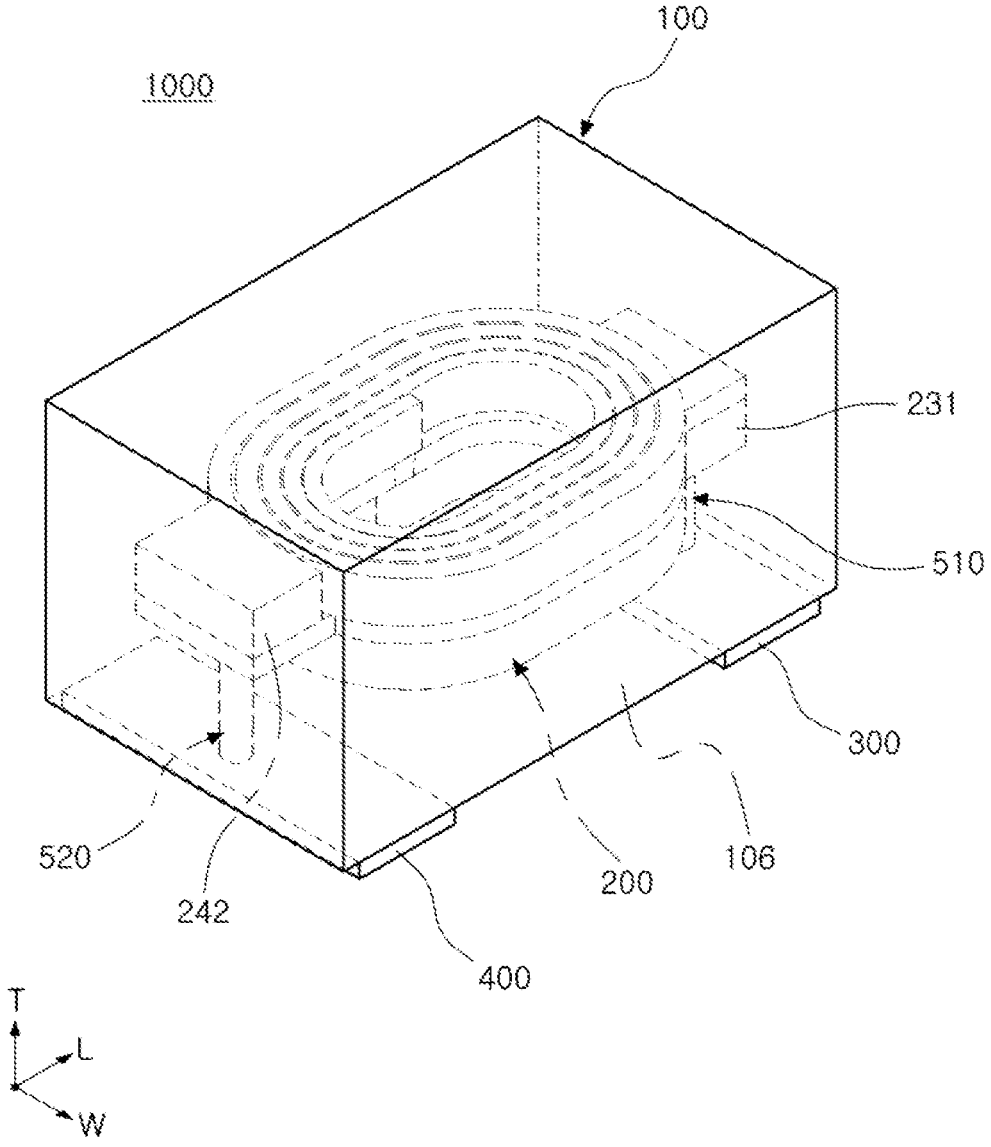
FIG. 2 is a schematic diagram of an inductor according to an example embodiment in the present disclosure.
Figure 3:
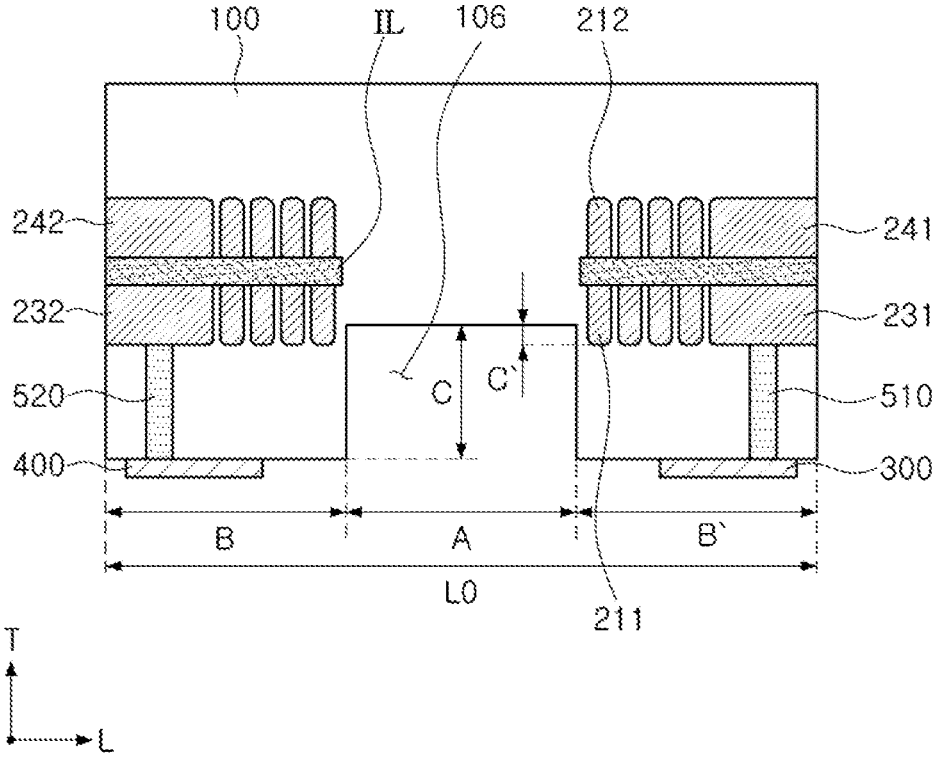
FIG. 3 is a cross-sectional view taken in an L-T direction of an inductor according to an example embodiment in the present disclosure.
Figure 4:
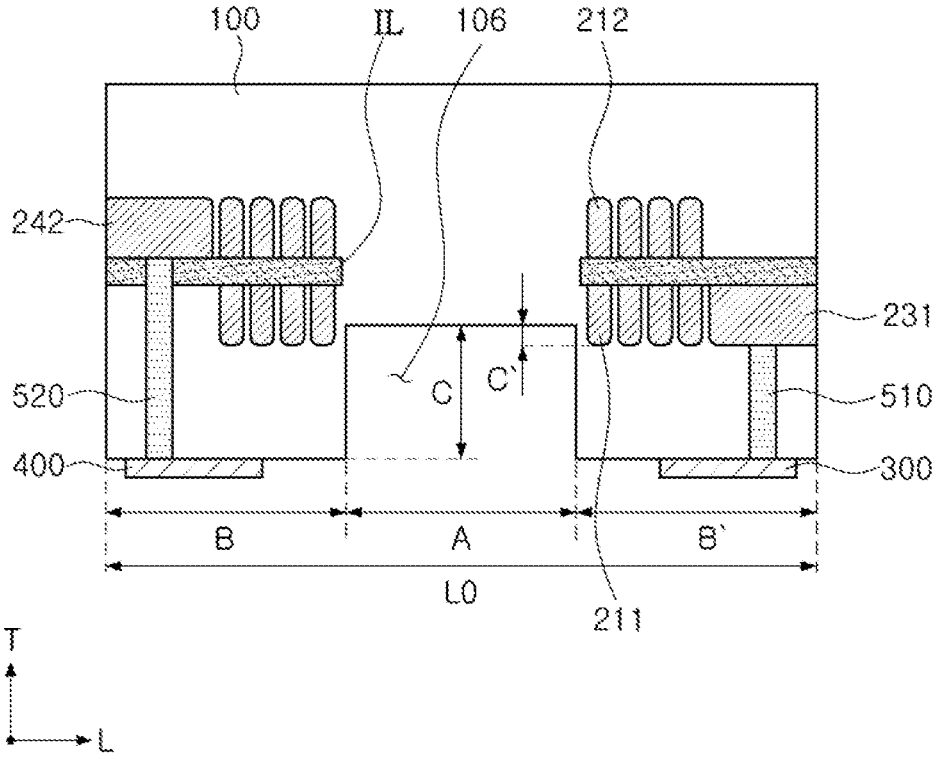
FIG. 4 is a cross-sectional view taken in an L-T direction of an inductor according to an example embodiment in the present disclosure.

FIG. 1 is a schematic diagram of an inductor according to embodiments in the present disclosure, and FIG. 2 is a schematic diagram of an inductor according to an example embodiment in the present disclosure. FIG. 3 is a cross-sectional view taken in an L-T direction of an inductor shown in FIG. 1 according to an example embodiment in the present disclosure. FIG. 4 is a cross-sectional view taken in an L-T direction of an inductor according shown in FIG. 2 to an example embodiment in the present disclosure.

Referring to FIG. 1, a recess portion 106, penetrating through a central portion of a lower end of a body 100, is spaced apart from bottom surface electrodes 300 and 400 (or external electrodes 300 and 400) by a certain distance, but is not limited thereto. For example, the recess portion 106 penetrates into a portion of the body 100 from an intermediate portion of a bottom surface of the body 100 between portions of the bottom surface on which the bottom surface electrodes 300 and 400 are respectively disposed. The recess portion 106 penetrates toward a central portion of the body 100. FIG. 1 illustrates that first, second, third, and fourth lead-out patterns 231, 242, 232, and 241 are all disposed on top and bottom surfaces of a support member to be in contact with a coil portion 200.

FIG. 3 is a cross-sectional view when FIG. 1 is viewed in the L-T direction. As illustrated by solid lines of FIG. 3, a connection electrode 520 connects the first lead-out pattern 231 and the third lead-out pattern 232 to the bottom surface electrode 400. In this case, the connection electrode 520 also penetrates through the third lead-out pattern 232 after the connection electrode 520 penetrates into the body 100. In one embodiment, the connection electrode 520 penetrates into the body 100 to connect the third lead-out pattern 232 and the bottom surface electrode 400 to each other, and the third lead-out pattern 232 is connected to the second lead-out pattern 242 by a via (not shown) in the support layer IL. As illustrated by solid lines of FIG. 3, a connection electrode 510 connects the first lead-out pattern 231 and the fourth lead-out pattern 241 to the bottom surface electrode 300. In this case, the connection electrode 510 also penetrates through the first lead-out pattern 231 after the connection electrode 510 penetrates into the body 100. In one embodiment, the connection electrode 510 penetrates into the body 100 to connect the first lead-out pattern 231 and the bottom surface electrode 300 to each other, and the first lead-out pattern 231 is connected to the fourth lead-out pattern 241 by another via (not shown) in the support layer IL. The another via may be omitted in another embodiment. In FIG. 3, A denotes a length of the recess portion 106, B' and B denote lengths of bottom surface portions of the body 100 on which the bottom surface electrodes 300 and 400 are respectively disposed, respectively, C denotes a length from a lower end of the body 100 to an upper end of the recess portion 106 (e.g., C denotes a depth of the recess portion 106 from the bottom surface of the body), and C' denotes a length from a lower end of a coil to the upper end of the recess portion 106 (e.g., C' denotes a difference between the depth C and a distance from the coil to the bottom surface of the body 100). For example, the depth C is greater than the distance from the coil to the bottom surface of the body 100. For ease of description, an external electrode and a shape, mounted on a substrate or the like, are not illustrated in FIGS. 1 and 3. Although not illustrated in the drawings, each corner portion of the body and internal corner portions of the recess portion may be formed to be rounded to prevent cracking.

Referring to FIG. 2, the recess portion 106, penetrating through a central portion of a lower end of the body 100, may be spaced apart from the bottom surface electrodes 300 and 400 by a certain distance, but is not limited thereto. For example, the recess portion 106 penetrates into a portion of the body 100 from an intermediate portion of the bottom surface of the body 100 between portions of the bottom surface on which the bottom surface electrodes 300 and 400 are respectively disposed. The recess portion 106 penetrates toward a central portion of the body 100. FIG. 1 illustrates that the first and second lead-out patterns 231 and 242 are additionally disposed on top and bottom surfaces of a support member to be in contact with a coil portion 200, as compared to the embodiment shown in FIG. 2.

FIG. 4 is a cross-sectional view when FIG. 2 is viewed in the L-T direction. As illustrated by solid lines of FIG. 4, a connection electrode 520 penetrates through a support member IL to be in contact with the first and second lead-out patterns 231 and 242 and the bottom surface electrodes 300 and 400. In one embodiment, the connection electrode 510 penetrates into the body 100 to be in contact with the first lead-out pattern 231. Although not shown, in another embodiment, the connection electrode 510 penetrates through the support member IL after passing through the first lead-out pattern 231. In FIG. 4, A denotes a length of the recess portion 106, B' and B denote lengths of bottom surface portions of the body 100 on which the bottom surface electrodes 300 and 400 are respectively disposed, respectively, C denotes a length from a lower end of the body 100 to an upper end of the recess portion 106 (e.g., C denotes a depth of the recess portion 106), and C' denotes a length from a lower end of a coil to the upper end of the recess portion 106 (e.g., C' denotes a difference between the depth C and a distance from the coil to the bottom surface of the body 100). For example, the depth C is greater than the distance from the coil to the bottom surface of the body 100. For ease of description, an external electrode and a shape, mounted on a substrate or the like, are not illustrated in FIGS. 2 and 4. Although not illustrated in the drawings, each corner portion of the body and internal corner portions of the recess portion may be formed to be rounded to prevent cracking.

The body 100 may include a magnetic material and a resin material. Specifically, the body 100 may be formed by laminating one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or magnetic metal powder particles.

The ferrite power particles may include at least one of, for example, spinel type ferrites such as ferrites that are Mg—Zn-based, Mn—Zn-based, Mn—Mg-based, Cu—Zn-based, Mg—Mn—Sr-based, Ni—Zn-based, hexagonal ferrites such as ferrites that are Ba—Zn-based, Ba—Mg-based, Ba—Ni-based, Ba—Co-based, Ba—Ni—Co-based, or the like, garnet ferrites such as Y-based ferrite, and Li-based ferrite.

Magnetic metal powder particles may include at least one selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may include at least one of pore ion power particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metallic magnetic powder particles may be amorphous or crystalline. For example, the magnetic metal powder particles may be Fe—Si—B—Cr-based amorphous alloy powder particles, but is not limited thereto.

Each of the ferrite and the magnetic metal powder particles may have an average diameter of about 0.1 μm to about 30 μm, but an example of the average diameter is not limited thereto.

The body 100 may include two or more different types of magnetic materials dispersed in a resin. The expression "different types of magnetic materials" refers to the fact the magnetic materials, dispersed in the resin, are distinguished from each other by any one of an average diameter, a composition, crystallinity, and a shape.

The resin may include epoxy, polyimide, liquid crystal polymer, and the like, alone or in combination, but a material of the resin is not limited thereto.

The coil portion 200 includes the first and second coil patterns 211 and 212 and the first, second, third, and fourth lead-out patterns 231, 242, 232, and 241, as shown in FIGS. 1 and 3. The coil portion 200 includes the first and second coil patterns 211 and 212 and the first and second lead-out patterns 231 and 242, as shown in FIGS. 2 and 4. The first and second coil patterns 211 and 212 are wound around an axis perpendicular, or substantially perpendicular, to the bottom surface of the body 100. The term, "substantially," reflects consideration of recognizable process errors which may occur during manufacturing. The body 100 includes a core penetrating through the coil portion 200. The core may be formed by filling a through-hole of the coil portion with a magnetic composite sheet, but formation of the core is not limited thereto.

The support member IL is embedded in the body 100. The support member IL supports the first and second coil patterns 211 and 212 and the first, second, third, and fourth lead-out patterns 231, 242, 232, and 241, as shown in FIGS. 1 and 3. The support member IL supports the first and second coil patterns 211 and 212 and the first and second lead-out patterns 231 and 242, as shown in FIGS. 2 and 4.

The support member IL may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a Bismaleimide Triazine (BT) resin, a photoimageable dielectric (PID), or the like, but is not limited thereto.

The inorganic filler may be at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support member IL is formed of an insulating material containing a reinforcing material, the internal insulating layer IL may provide more excellent rigidity. When the internal insulating layer IL is formed of an insulating material including no glass fiber, the internal insulating layer IL is advantageous for thinning of the entire coil portion 200. When the internal insulating layer IL is formed of an insulating material including a photosensitive insulating resin, the number of processes may be decreased, which is advantageous for a decrease in manufacturing costs, and a fine via may be formed.

The coil portion 200 may be embedded in the body 100 to exhibit characteristics of a coil component. For example, when the coil component 1000 according to this embodiment is used as a power inductor, the coil portion 200 may serve to stabilize power of an electronic device by storing an electric field as a magnetic field and maintaining an output voltage.

The coil portion 200 is disposed on a first surface and a second surface of the support member IL, opposing each other, and includes the first and second coil patterns 211 and 212 and the first, second, third, and fourth lead-out patterns 231, 242, 232, and 241, as shown in FIGS. 1 and 3. The coil portion 200 is disposed on the first surface and the second surface of the support member IL, opposing each other, and includes the first and second coil patterns 211 and 212 and the first and second lead-out patterns 231 and 242, as shown in FIGS. 2 and 4.

Specifically, on the basis of directions of FIG. 3, the first coil pattern 211, the first lead-out pattern 231, and the third lead-out pattern 232 are disposed on a bottom surface of the support member IL, and the second coil pattern 212, the second lead-out pattern 242, and the fourth lead-out pattern 241 are disposed on a top surface of the support member IL opposing the bottom surface of the support member IL. On the basis of directions of FIG. 4, the first coil pattern 211 and the first lead-out pattern 231 are disposed on the bottom surface of the support member IL, and the second coil pattern 212 and the second lead-out pattern 242 are disposed on the top surface of the support member IL.

Referring to FIG. 3, the first coil pattern 211 is electrically connected to the first lead-out pattern 231 on the bottom surface of the support member IL, and the first coil pattern 211 and the first lead-out pattern 231 are spaced apart from the third lead-out pattern 232. The second coil pattern 212 is electrically connected to the second lead-out pattern 242 on the top surface of the support member IL, and the second coil pattern 212 and the second lead-out pattern 242 are spaced apart from the fourth lead-out pattern 241. Thus, the coil portion may generally serve as a single coil forming one or more turns around the core. The first connection electrode 510 is in contact with the first lead-out pattern 231 and the first lead-out pattern 231 is connected to the fourth lead-out pattern 241, and the second connection electrode 520 is in contact with the third lead-out pattern 232 and the third lead-out pattern 232 is connected to the second connection pattern 242. Since it is not necessary to vary the depth of the hole penetrating at least a portion of the magnetic composite sheet, as described below, the process of forming the connection electrodes 510 and 520 may be simplified compared to FIG. 4.

Referring to FIG. 4, the first connection electrode 510 is in contact with the first lead-out pattern 231 and the second connection electrode 520 penetrates through the support member IL to be in contact with the second lead-out pattern 242. The first and second connection electrode 510 and 520 are formed by varying the depth of the hole penetrating at least a portion of the magnetic composite sheet, as will be described later.

At least one of the coil patterns 211 and 212, the connection electrodes 510 and 520, and the lead-out patterns 231, 242, 232, and 241 may include at least one conductive layer.

As an example, when the second coil pattern 212, the second and fourth lead-out patterns 241 and 242, and the connection electrodes 510 and 520 are formed on the other surface of the support member IL by plating, each of the second coil pattern 212, the second and fourth lead-out patterns 241 and 242, and the connection electrodes 510 and 520 may include a seed layer such as an electroless plating layer and an electroplating layer. The electroplating layer may have a single-layer structure or a multilayer structure. The electroplating layer of the multilayer structure may be formed in a conformal film structure in which one electroplating layer is covered with another electroplating layer, and may be formed so that another plating layer is only laminated on one surface of one electroplating layer. The seed layer of the second coil pattern 212, the seed layers of the second and fourth lead-out patterns 241 and 242, and the seed layers of the connection electrodes 510 and 520 may be formed integrally with each other, such that boundaries therebetween may not be formed, but are not limited thereto. The electroplating layer of the second coil pattern 212, the electroplating layers of the second and fourth lead-out patterns 241 and 242, and the electroplating layers of the connection electrodes 510 and 520 may be formed integrally with each other, such that boundaries therebetween are not formed, but are not limited thereto.

Each of the coil patterns 211 and 212, the first and third lead-out patterns 231 and 232, the second and fourth lead-out patterns 242 and 241, and the connection electrodes 510 and 520 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Referring to FIG. 4, when the first and second lead-out patterns 231 and 242 are present, the third and fourth lead-out patterns 232 and 241 have no relation to an electrical connection between the other elements of the coil portion. Therefore, the third and fourth lead-out patterns 232 and 241 may be omitted in the present disclosure.

Referring to FIGS. 1, 2, 3, and 4, external electrodes 300 and 400 may be disposed on one surface of the body 100 to be spaced apart from each other and respectively connected to both ends of a coil inside the body 100. In FIGS. 1 and 2, the body 100 is illustrated as having a width equal to a width of each of the external electrodes 300 and 400 in a width direction W of the body 100. However, since this is only an example, each of the external electrodes 300 and 400 may have a size different from that illustrated in FIG. 1.

Referring to FIGS. 3 and 4, the recess portion 106 is formed in a region between the first and second external electrodes on one surface of the body 100. The recess portion 106 may be formed by radiation of $CO_2$ laser, but a method of forming the recess portion 106 is not limited thereto. The recess portion 106 may extend from both side surfaces of the body 100 in a width direction, but a shape of the recess portion 106 is not limited thereto.

When a length of a portion of the bottom surface on which the external electrode 400 is disposed, is B, and a length of a portion of the bottom surface on which the external electrode 300 is disposed, is B', a ratio of a sum of the lengths B and B' to a length A of the recess portion 106 may be adjusted. Specifically, $2A \leq B+B' < 3A$ in which B+B' (e.g., L0−A, in which L0 is the length of the body in the length direction L) is the sum of the lengths of the bottom surface electrode portions and A is the length of the recess portion 106. The above condition may be satisfied to improve mounting stability and to prevent short-circuit between a bottom surface electrode and a substrate. When B+B' (e.g., L0−A) is smaller than 2A, short-circuit between the bottom surface electrode and the substrate may be prevented but a contact area with a mounting surface may be reduced to degrade the mounting stability. When B+B' (L0−A) is greater than 3A, the mounting stability may be satisfactory but there may be increasing concern that short-circuit occurs between bottom surface electrodes, which is not desirable.

When a length from a lower end of the body 100 to an upper end of the recess portion 106 is C and a length from a lower end of the coil to the upper end of the recess portion 106 is C', an effect of preventing short-circuit between the coil and a bottom surface electrode may be adjusted. Specifically, when C>C', an effect of preventing short-circuit is greatest. When C is less than or equal to C', short-circuit occurs between the coil and the bottom surface electrode. For example, when the depth C is greater than the distance from the coil portion to the bottom surface, an effect of preventing short-circuit is greatest, and when the depth C is equal to or less than the distance from the coil portion to the bottom surface, short-circuit occurs between the coil and the bottom surface electrode.

The first and second external electrodes 300 and 400 may be formed to have a single-layer structure or a multilayer structure. As an example, the first external electrode 300 may include a first layer including copper (Cu), a second layer, disposed on the first layer, including nickel (Ni), and a third layer, disposed on the second layer, including tin (Sn). As another example, the first external electrode 300 may include a resin electrode, including conductive power particles and a resin, and a plating layer disposed on the resin electrode.

Each of the external electrodes 300 and 400 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

The connection electrodes 510 and 520 may penetrate through the body 100 to be connect the first and second external electrodes 300 and 400 and the first and second coil patterns 211 and 212 to each other. The first connection electrode 510 connects the first external electrode 300 and the first lead-out pattern 231 to each other, and the second connection electrode 520 connect the second external electrode 400 and the third lead-out pattern 232 to each other. The connection electrodes 510 and 520 extend from a lead-out pattern to the first and second external electrodes 300 and 400.

The connection electrodes 510 and 520 may be formed by forming the first and third lead-out patterns 231 and 232 after laminating a magnetic composite sheet to form a body 100 or forming a hole to penetrate through at least a portion of a magnetic composite site and filling the hole with a conductive material. In the case of the former, since a seed layer is not needed when the connection electrodes 510 and 520 are formed by electroplating, the connection electrodes 510 and 520 may be formed of only an electroplating layer. As compared with the latter, since a hole does not need to be processed in the body 100 to expose the first and third lead-out patterns 231 and 232, matching between the connection electrodes 510 and 520 and the first and third lead-out patterns 231 and 232 may be more precisely achieved, and they may be collectively formed in a plurality of unit coils at a strip level or a panel level. In the case of the latter, a seed layer such as an electroless plating layer may be interposed between a hole and the connection electrodes 510 and 520 and between the first and third lead-out patterns 231 and 232 and the connection electrodes 510 and 520.

The connection electrodes 510 and 520 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Although not illustrated in the drawings, in this embodiment, an insulating layer, formed along surfaces of the first and third lead-out patterns 231 and 232, the coil patterns 311 and 312, the support member IL, and the second and fourth lead-out patterns 242 and 241, may be further included. The insulating layer may insulate the first and third lead-out patterns 231 and 232, the coil patterns 311 and 312, and the second and fourth lead-out patterns 242 and 241 from the body 100 and may include a known insulating material such as parylene or the like. A material of the insulating material may be any insulating material and is not limited. The insulating layer may be formed by vapor deposition or the like, but a method of forming the insulating layer is not limited thereto and may be formed by laminating an insulating film on both surfaces of the support member IL.

Thus, an inductor according to this embodiment may prevent short-circuit with another component when the inductor is mounted on a substrate, or the like, as a bottom electrode structure introducing a recess portion formed by recessing a center portion of a body. Moreover, high reliability and inductor characteristics may be secured in spite of miniaturization of a component.

As described above, according to the present disclosure, short-circuit between both electrodes and cracking may be prevented when a bottom surface electrode is formed.

In addition, according to the present disclosure, soldering may be optimized and mounting stability may be enhanced while preventing short-circuit of a bottom surface electrode.

While example embodiments have been shown and described above, it will be apparent to those skilled in the art that modifications and variations could be made without departing from the scope of the present disclosure as defined by the appended claims.

What is claimed is:

1. An inductor comprising:

a body;

a coil disposed inside the body; and first and second external electrodes disposed on one surface of the body to respectively be connected to both ends of the coil, wherein a recess portion is disposed in a region between the first and second external electrodes on the one surface of the body.

2. The inductor of claim 1, further comprising:

a support member disposed inside the body supporting the coil.

3. The inductor of claim 2, further comprising:

the coil includes first and second coils respectively disposed on a first surface and a second surface of the support member, opposing each other.

4. The inductor of claim 1, further comprising:

first and second connection electrodes connecting the coil and the first and second external electrodes to each other, respectively.

5. The inductor of claim 4, wherein the first and second connection electrodes are exposed outwardly of the body.

6. The inductor of claim 4, wherein the first and second connection electrode are disposed inside the body.

7. The inductor of claim 1, wherein $2A \leq L0 - A < 3A$, in which A is a length of the recess portion in a length direction of the body and L0 is a length of the body in the length direction.

8. The inductor of claim 1, wherein C>C', in which C is a length from a lower end of the body to an upper end of the recess portion, and C' is a length from a lower end of the coil to the upper end of the recess portion.

9. The inductor of claim 1, wherein a depth of the recess portion from the one surface is greater than a distance from the coil to the one surface.

10. The inductor of claim 1, wherein the first and second external electrodes are disposed only on the one surface.

11. The inductor of claim 1, wherein the first and second external electrodes are spaced apart from opposing surfaces in a length direction of the body.

12. The inductor of claim 1, wherein the coil is wound around an axis substantially perpendicular to the one surface.

13. An inductor comprising:

a body having a recess portion recessed from one surface of the body toward a central portion of the body;

a coil disposed inside the body and wound around the central portion of the body; and first and second external electrodes disposed on opposing sides of the one surface and connected to ends of the coil, respectively.

14. The inductor of claim 13, further comprising:

first and second connection electrodes disposed in the body, and connecting the ends of the coil and the first and second external electrodes to each other, respectively.

15. The inductor of claim 13, wherein $2A \leq L0 - A < 3A$, in which A is a length of the recess portion in a length direction of the body and L0 is a length of the body in the length direction.

16. The inductor of claim 13, wherein C>C', in which C is a length from a lower end of the body to an upper end of the recess portion, and C' is a length from a lower end of the coil to the upper end of the recess portion.

17. The inductor of claim 13, wherein a depth of the recess portion from the one surface is greater than a distance from the coil to the one surface.

18. The inductor of claim 13, wherein the first and second external electrodes are disposed only on the one surface.

19. The inductor of claim 13, wherein the first and second external electrodes are spaced apart from opposing surfaces in a length direction of the body.

20. The inductor of claim 13, wherein the coil is wound around an axis substantially perpendicular to the one surface.

21. The inductor of claim 13, wherein the recess portion is spaced apart from the first and second external electrodes.

22. The inductor of claim 1, wherein the recess portion is spaced apart from the first and second external electrodes.

* * * * *